US006742291B2

(12) United States Patent
Frigon et al.

(10) Patent No.: US 6,742,291 B2
(45) Date of Patent: Jun. 1, 2004

(54) THUMB FOR SCOOPING TOOL ARM

(76) Inventors: Denis Frigon, 180, Avenue Frigon, Landrienne (Québec) (CA), J0Y 1V0; Frédéric Sylvain, 233, Principale, Landrienne (Québec) (CA), J0Y 1V0

( * ) Notice: Subject to any disclaimer, the term of this patent is extended or adjusted under 35 U.S.C. 154(b) by 0 days.

(21) Appl. No.: 10/163,880

(22) Filed: May 24, 2002

(65) Prior Publication Data

US 2003/0024138 A1 Feb. 6, 2003

(30) Foreign Application Priority Data

Aug. 6, 2001 (CA) ..... 2355405

(51) Int. Cl.[7] ..... E02F 3/40; E02F 3/96

(52) U.S. Cl. ..... 37/406; 37/903; 414/722; 414/739

(58) Field of Search ..... 37/406, 903; 414/722, 414/739

(56) References Cited

U.S. PATENT DOCUMENTS

| | | | | | |
|---|---|---|---|---|---|
| 3,651,966 | A | * | 3/1972 | Willett | 414/735 |
| 4,285,628 | A | * | 8/1981 | Jankowski | 414/739 |
| 4,372,063 | A | * | 2/1983 | Work | 37/301 |
| 4,375,345 | A | * | 3/1983 | Hanson | 414/722 |
| 4,519,739 | A | * | 5/1985 | Risch | 414/724 |
| 4,799,852 | A | * | 1/1989 | Ramun | 414/724 |
| 5,111,602 | A | * | 5/1992 | Risch | 37/406 |
| 5,123,185 | A | * | 6/1992 | Pollard | 37/406 |
| D332,271 | S | * | 1/1993 | DuBose et al. | D15/32 |
| 5,472,308 | A | | 12/1995 | Somero | |
| 5,544,435 | A | | 8/1996 | Somero | |
| 5,553,408 | A | * | 9/1996 | Townsend | 37/406 |
| 5,590,482 | A | * | 1/1997 | Peterson et al. | 37/403 |
| 5,678,332 | A | | 10/1997 | Hawkins | |
| 5,794,673 | A | | 8/1998 | Milbourn et al. | |
| 5,813,822 | A | | 9/1998 | Pisco | |
| 5,921,302 | A | * | 7/1999 | Petersen | 144/334 |
| 5,927,933 | A | * | 7/1999 | Tucker | 414/729 |
| 5,957,650 | A | * | 9/1999 | Rollo | 414/724 |
| 6,098,320 | A | * | 8/2000 | Wass | 37/406 |
| 6,120,237 | A | * | 9/2000 | Cummings et al. | 414/729 |
| 6,131,978 | A | * | 10/2000 | Rounds | 294/106 |
| 6,135,290 | A | * | 10/2000 | Heiple | 209/421 |
| 6,148,254 | A | | 11/2000 | Barden | |
| 6,176,531 | B1 | * | 1/2001 | Wheeler | 294/88 |
| 6,203,267 | B1 | * | 3/2001 | Heiple et al. | 414/722 |
| 6,260,294 | B1 | * | 7/2001 | Pitcher | 37/406 |
| 6,267,547 | B1 | * | 7/2001 | Lund | 414/697 |
| 6,287,072 | B1 | * | 9/2001 | Wasilas | 414/729 |
| 6,357,993 | B1 | * | 3/2002 | Burton | 414/724 |
| 6,453,586 | B1 | * | 9/2002 | Wolin et al. | 37/406 |
| 6,526,678 | B2 | * | 3/2003 | Waddington, Jr. | 37/406 |

FOREIGN PATENT DOCUMENTS

| | | | | |
|---|---|---|---|---|
| JP | 09298903 A | * | 11/1997 | A01B/33/10 |
| WO | WO 89/12145 | * | 12/1989 | E02F/3/40 |

* cited by examiner

*Primary Examiner*—Christopher J. Novosad
(74) *Attorney, Agent, or Firm*—Louis Martineau

(57) ABSTRACT

The thumb is used on a hydraulic tool arm equipped with a scooping tool for selective co-operation between the scooping tool and the thumb. The thumb has a pair of generally parallel U-shaped lateral forks defining an opening therebetween for engagement of the tool arm between the forks. The forks define an inner end having a transverse coupling member for operative coupling of the thumb to the tool arm for movement of the thumb about the tool arm, and an outer free end opposite the inner end. The forks are significantly curved about a common axis.

14 Claims, 7 Drawing Sheets

THUMB FOR SCOOPING TOOL ARM

FIELD OF THE INVENTION

The present invention relates to mechanical scooping tool arms such as hydraulic shovels, hydraulic rakes and the like, and more particularly to a thumb for such a scooping tool arm.

BACKGROUND OF THE INVENTION

Articulated mechanical scooping tool arms are often operatively mounted to a vehicle to allow heavy or large materials to be handled. Such material handling apparatuses include hydraulic shovels, hydraulic rakes, and the like. In all these cases, a scooping tool, such as a bucket or a rake, is provided at the outer free end portion of an articulated boom, and is remotely controlled from the vehicle cab through the instrumentality of hydraulic cylinders. The scooping tool can be used to accomplish a number of different operations, one of them being to scoop up materials to transport them. For example, a bucket can be used to dig a hole in the ground, or to scoop up and lift a heavy container to carry it to a desired destination.

In the cases of vehicles equipped with a scooping tool in the form of a hydraulic shovel, it is known to operatively mount a hydraulically controlled thumb on the tool arm of the vehicle in pivotal facing register with the bucket of the hydraulic shovel, the thumb pivotally co-operating with the bucket of the hydraulic shovel to allow objects to be grasped between the bucket and the thumb, or to be pushed by the thumb into the bucket. However, the known thumbs are cumbersome when they are positioned in a stored condition away from the bucket, and their shapes are not adapted for efficiently handling materials without damaging these materials.

SUMMARY OF THE INVENTION

The present invention relates to a thumb to be mounted for relative movement on a hydraulic tool arm equipped with a pivotable scooping tool for selective co-operation between the scooping tool and said thumb, said thumb comprising a pair of generally parallel transversely spaced arcuate U-shaped lateral forks, said forks having inner ends transversely interconnected by an integral transverse coupling member having for operative coupling of said thumb to the tool arm for relative movement thereabout, and outer ends opposite said inner end, said arcuate forks defining a significantly short radius of curvature about a common axis relative to the distance between said inner and outer ends.

In one embodiment, the thumb further comprises a transverse plate integrally linking said forks at said outer ends thereof.

In one embodiment, said coupling member is a pivotal coupling member and defines a pivotal axis.

In one embodiment, said forks define a concave inner surface and a ratio L1:L2 approximately equal to 3:1 is defined on said thumb, where L1 is equal to the length between said pivotal axis and said forks outer ends, and where L2 is equal to the length between (a) a line drawn between said pivotal axis and said forks outer ends, and (b) the most distant point between said concave inner surface of said forks and said line.

In one embodiment, said forks are defined along a major part of their length starting at said outer ends, by a single radius of curvature R1, and a ratio L1:R1 approximately equal to 2:1 is defined on said thumb, where L1 is equal to the length between said pivotal axis and said forks outer ends.

The present invention also relates to a thumb assembly for use on a tool arm equipped with a scooping tool, comprising a thumb for selective co-operation with the scooping tool, said thumb comprising a pair of generally parallel U-shaped lateral forks defining an opening therebetween for engagement of the tool arm between said forks, said forks having inner ends for pivotable attachment to the tool arm and outer ends opposite said inner ends, said forks being significantly curved about a common axis for providing a hollow opening between the scooping tool and said thumb when said thumb forks outer ends engage the scooping tool and for allowing a significant portion of said thumb to be positioned beyond a surface of the tool arm which is in pivotal facing register with a scooping side of the scooping tool when said thumb is pivoted against the tool arm, said thumb assembly further comprising an actuator operatively attached to said thumb for allowing pivotal displacement of said thumb relative to the scooping tool.

The invention also relates to a thumb and scooping tool assembly for operative attachment to a tool arm, comprising:

a) a thumb, said thumb comprising a pair of generally parallel U-shaped lateral forks defining an opening therebetween for engagement of the tool arm between said forks, said forks having inner ends for attachment to the tool arm for relative movement thereabout, and outer ends opposite said inner ends, said forks being significantly curved about a common axis;

b) a scooping tool selectively co-operating with said thumb and comprising an inner end for pivotable attachment to the tool arm, an outer end opposite said inner end, and a scooping side in pivotal facing register with said thumb for grasping objects between said thumb and said scooping tool scooping side;

c) mounting means, for mounting said thumb forks inner ends and said cooping tool to the tool arm for relative movement thereabout;

d) a first actuator operatively attached to said thumb for selective motion of said thumb relative to said scooping tool and to the tool arm; and e) a second actuator operatively attached to said scooping tool for selective motion of said scooping tool relative to said thumb and to the tool arm.

The invention further relates to a tool arm assembly comprising an elongated tool arm having an outer free end equipped with a scooping tool and a thumb, said thumb comprising a pair of generally parallel U-shaped lateral forks defining an opening therebetween, said forks having inner ends, a pivot member pivotably attaching said forks inner ends to the tool arm outer free end for pivotal movement of said thumb about a pivotal axis, and outer ends opposite said inner ends, said forks being significantly curved about a common axis, said scooping tool selectively co-operating with said thumb and comprising an inner end pivotably attached to said pivot member for pivotal motion relative to said tool arm outer free end, an outer end opposite said inner end, and a scooping side in pivotal facing register with said thumb for grasping objects between said thumb and said scooping tool scooping side, said tool arm assembly further comprising a first power actuator operatively attached to said tool arm and to said thumb for selectively pivoting said thumb relative to said scooping tool and to said tool arm, said tool arm assembly further comprising a second power actuator operatively attached to said tool arm and to said scooping tool for selectively pivoting said scooping tool relative to said thumb and to said tool arm;

wherein said pivot member enables said thumb and said scooping tool to be independently pivotable relative to one another and to said tool arm about parallel axes, and wherein said thumb is pivotable between a first limit position in which said forks outer end engages said scooping tool scooping side, and a second limit position in which said thumb is pivoted away from said scooping tool scooping side and said tool arm is embedded in said opening between said thumb forks, with a transverse hollow opening being defined between said forks and said scooping tool scooping side in said first limit position of said forks for transverse, uncompressed engagement of objects carried therein, and with a significant portion of said thumb extending beyond a surface of said tool arm that is in pivotal facing register with said scooping tool scooping side when said thumb is in said second limit position.

In one embodiment, said thumb and said scooping tool both pivot about said pivotal axis.

In one embodiment, said thumb comprises a transverse plate integrally linking said forks at said outer ends thereof, with said transverse plate being positioned, in all positions of said thumb, between said scooping tool scooping side and said surface of said tool arm that is in pivotal facing register with said scooping tool scooping side.

The invention further relates to a vehicle comprising:

a frame movable over ground;

a boom pivotably attached to said frame;

an elongated tool arm having an inner end pivotally attached to said boom and an outer free end opposite said inner end and equipped with a scooping tool and a thumb, said thumb comprising a pair of generally parallel U-shaped lateral forks defining an opening therebetween, said forks having an inner end pivotably attached to the tool arm outer free end and an outer end opposite said inner end, said forks being significantly curved about a common axis, said scooping tool selectively co-operating with said thumb and comprising an inner end pivotably attached to the tool arm outer free end, an outer end opposite said inner end, and a scooping side in pivotal facing register with said thumb for grasping objects between said thumb and said scooping tool scooping side;

a first actuator operatively attached to said tool arm and to said thumb for selectively pivoting said thumb relative to said scooping tool and to said tool arm;

a second actuator operatively attached to said tool arm and to said scooping tool for selectively pivoting said scooping tool relative to said thumb and to said tool arm;

a third actuator operatively attached to said boom and to said tool arm, for selectively pivoting said tool arm relative to said boom;

a fourth actuator operatively attached to said vehicle frame and to said boom, for selectively pivoting said boom relative to said vehicle;

wherein said thumb and said scooping tool are independently pivotable about parallel axes, and wherein said thumb is pivotable between a first limit position in which said forks outer end engages said scooping tool scooping side, and a second limit position in which said thumb is pivoted away from said scooping tool scooping side and said tool arm is embedded in said opening between said thumb forks, with a transverse hollow opening being defined between said forks and said scooping tool scooping side in said first limit position of said forks for transverse, uncompressed engagement of objects carried therein, and with a significant portion of said thumb extending beyond a surface of said tool arm that is in pivotal facing register with said scooping tool scooping side when said thumb is in said second limit position.

In one embodiment, said scooping tool is a bucket.

In one embodiment, said scooping tool is a rake.

DETAILED DESCRIPTION OF THE EMBODIMENTS

Figure 1:
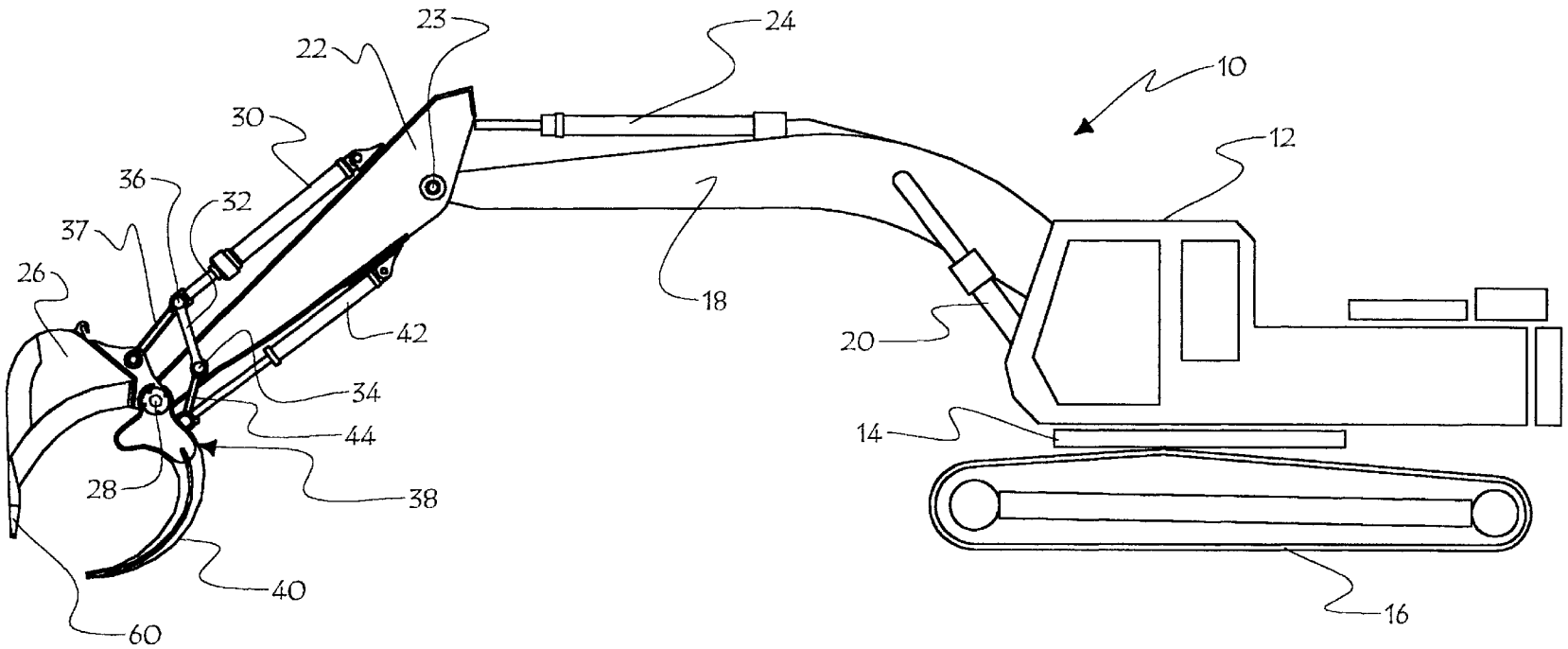
FIG. 1 is a side elevation of a vehicle comprising a tool arm equipped with a thumb according to the present invention.

FIG. 1 shows a material handling vehicle 10 comprising a cab 12 rotatably mounted, by means of a turntable 14, to a frame (concealed in FIG. 1) carried over ground by a pair of tracks 16. Cab 12 can thus be moved over ground and can rotate about a vertical axis (if vehicle 10 is located over horizontal ground), as known in the art.

An elongated boom 18 is pivotably attached to cab 12, with a boom cylinder 20 controlling the pivotal displacement of boom 18. Boom cylinder 20 is attached at its first end to cab 12 and at its second end to boom 18. An elongated tool arm 22 is pivotally attached to boom 18 at 23, at the end of boom 18 opposite cab 12, with an arm cylinder 24 controlling the pivotal displacement of tool arm 22. Arm cylinder is attached at its first end to cab 12, and at its second end to boom 18.

FIGS. 1–4 and 7 show that tool arm 22 carries a tool in the form of a bucket 26 which is pivotally attached to tool arm 22 by means of a hinge pin 28 which transversely extends through the outer free end of tool arm 22. Bucket 26 is controlled in its pivotal displacement by means of a bucket cylinder 30. Bucket cylinder 30 is attached at its first end to tool arm 22, and at its second end to bucket 26. A pair of bucket pivot rods 32 is pivotally attached at its first end to tool arm 22 by means of a pivot pin 34, and at its second end to an articulation joint 36 provided on at the outer end of the piston of bucket cylinder 30. A pair of bucket link rods 37 link articulation joint 36 to bucket 26, with bucket link rods 37 being pivotally attached to articulation 36 and pivotally attached to bucket 26 spacedly from hinge pin 28.

FIGS. 1–4 show that, according to the present invention, vehicle 10 is equipped with a thumb assembly 38. Thumb assembly 38 comprises a thumb 40 pivotally attached by means of hinge pin 28 to the outer free end of tool arm 22. Thus, hinge pin 28 is used to pivotally attach both thumb 32 and bucket 26 to the outer free end of tool arm 22, although both are independently pivotable relative to tool arm 22. Thumb assembly 38 further comprises a thumb cylinder 42, attached to tool arm 22 at its first end and to thumb 40 at its second end, with thumb cylinder 42 controlling the pivotal displacement of thumb 40. A pair of thumb pivot rods 44 are pivotally attached to pivot pin 34 at their first end, and to an articulation joint 45 at their second end, with articulation joint 45 being in turn linked to thumb 40 by means of an arcuate thumb link rod 47.

As shown in FIGS. 1–7, thumb 40 comprises a generally annular main body having a pair of generally parallel curved forks 46, 48 linked at their inner end, near hinge pin 28 although spacedly therefrom, by an inner transverse hollow cylindrical pivot sleeve 50 and at their outer free end, opposite hinge pin 28, by an outer transverse plate 52. Inner transverse sleeve 50 has a notch 54, with thumb link rod 47 being attached through notch 54 to a pivot pin (concealed by sleeve 50 in the drawings) located inside sleeve 50. Outer transverse plate 52 has a semi-circular notch 56 for free engagement therein of thumb cylinder 42 in some positions of thumb 40.

It can be seen that the lateral forks 46, 48 have larger base portions 46*a*, 48*a*, opposite outer transverse plate 52, where sockets 46*b*, 48*b* are provided for engagement there of hinge pin 28. Transverse sleeve 50 links the forks base portions 46*a*, 48*a*. Also, U-shaped forks 46, 48 are curved about a common axis.

Boom cylinder 20, tool arm cylinder 24, bucket cylinder 30 and thumb cylinder 42 can all be controlled remotely from cab 12.

Figure 2:
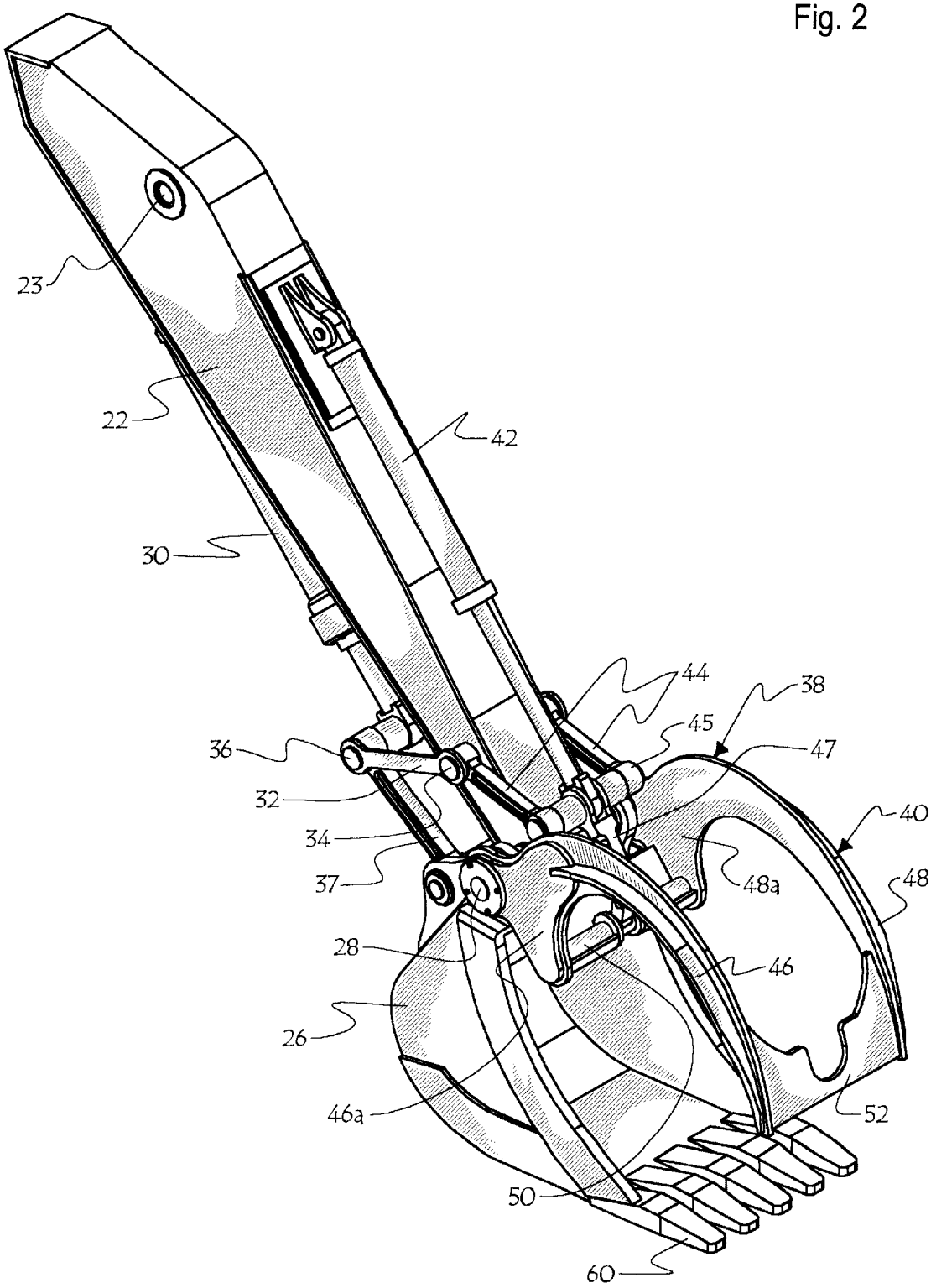
FIGS. 2 and 3 are enlarged perspective views of the tool arm equipped with the thumb of the invention, respectively showing the thumb in a first position in which it is pivoted towards the bucket of the tool arm, and in a second position in which it is pivoted away from the bucket, engaging the tool arm in a stored position.
Figure 3:
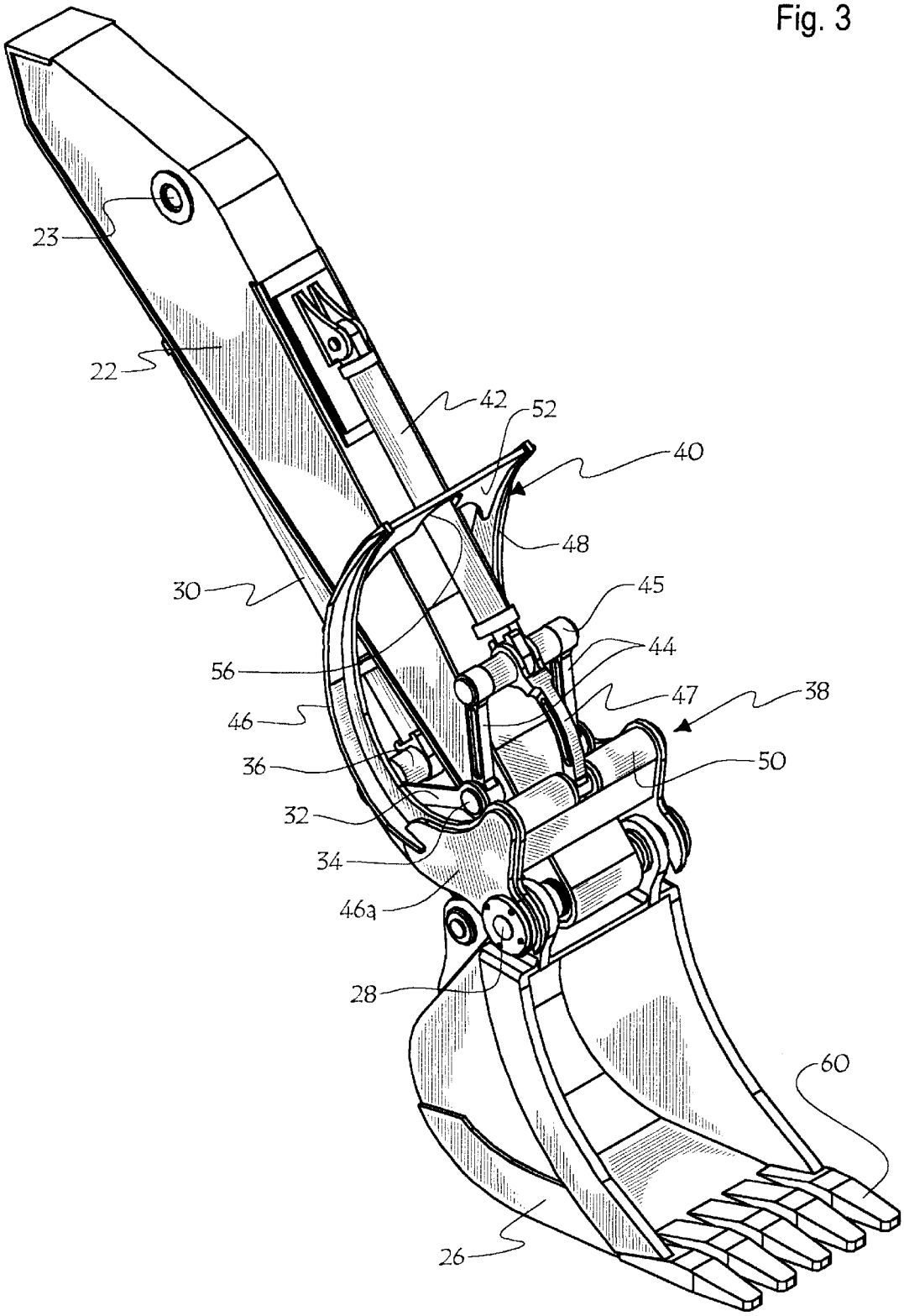
Figure 4:
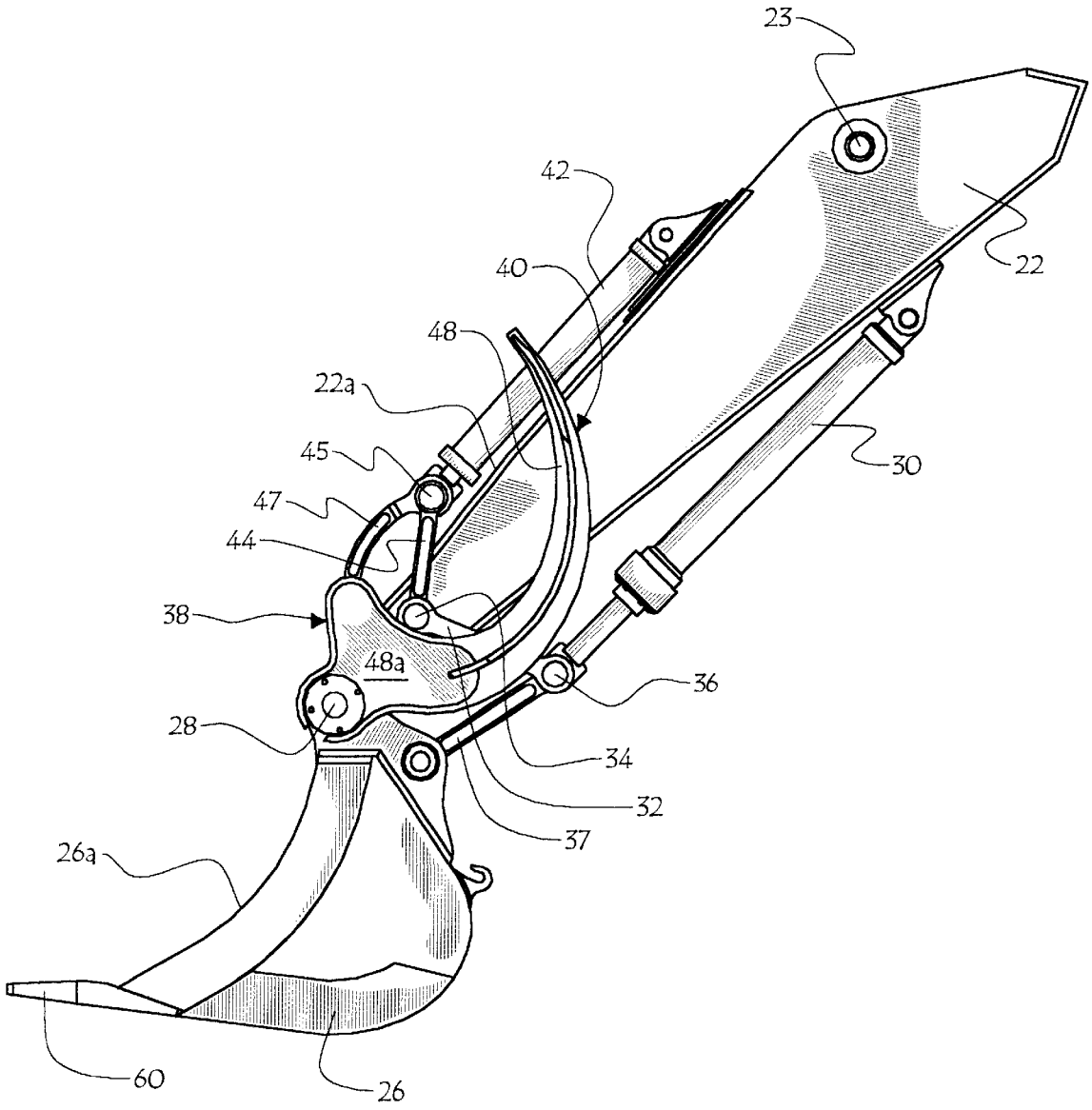
FIG. 4 is a side elevation of the tool arm equipped with the thumb of the invention in its stored position of FIG. 3.
Figure 7:
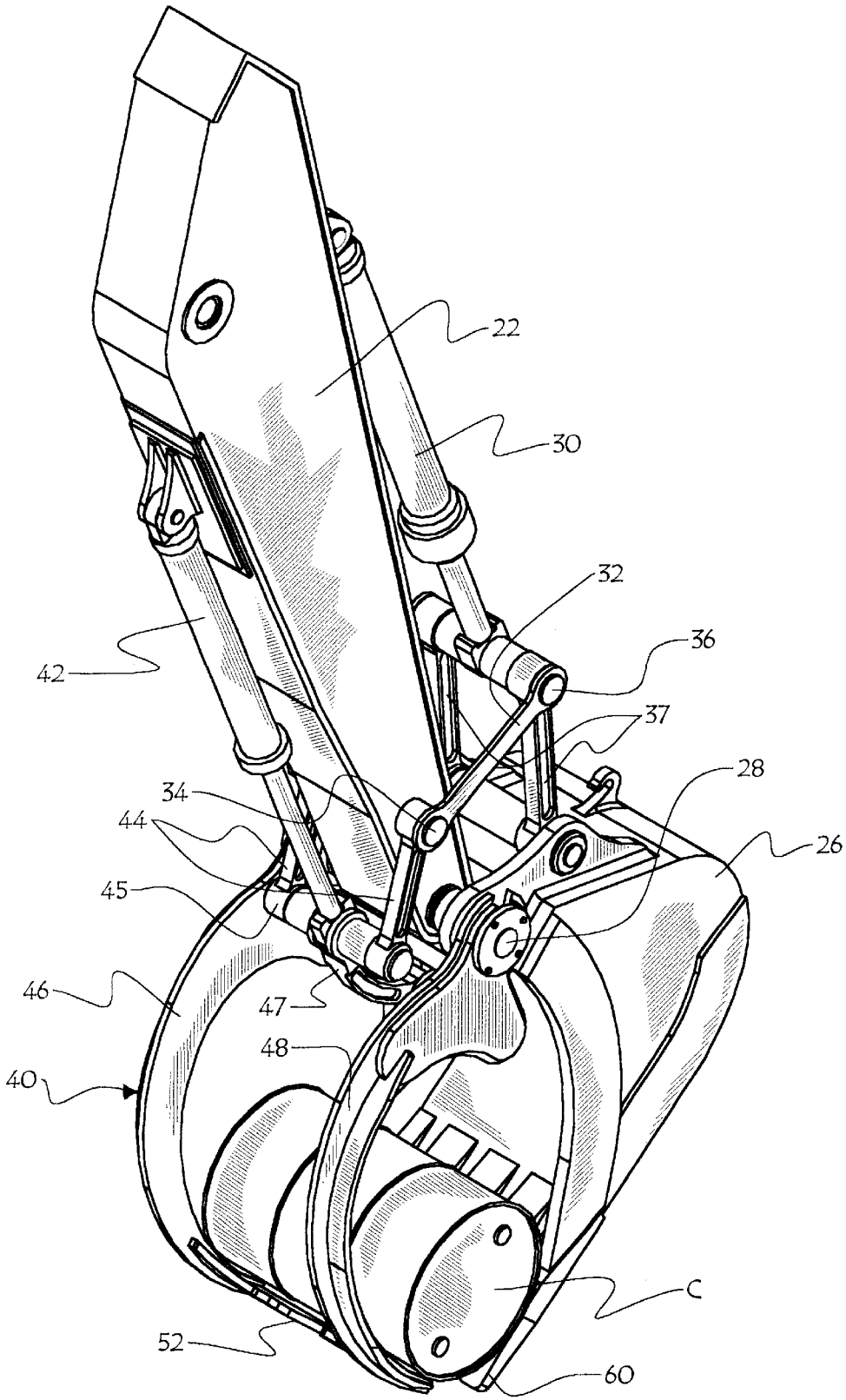
FIG. 7 is a perspective view of the tool arm equipped with a thumb according to the invention, with the thumb and the bucket of the tool arm co-operating to grasp and handle a cylindrical container.

Thus, upon the piston rod of thumb cylinder 42 being activated, thumb link rod 47 will act on the pivot pin located inside thumb inner transverse sleeve 50, to pivotally rotate thumb 40 between a first fully opened inoperative limit position shown in FIGS. 3 and 4 where transverse plate 52 is adjacent to and almost abuts against cylinder 42 and tool arm 22, through an intermediate jaw grasping position shown in FIGS. 1 and 2, and into a second closed load-securing limit position shown in FIG. 7.

In its opened limit position, thumb 40 extends generally along tool arm 22. More specifically, tool arm 22 becomes embedded into the opening 58 (FIG. 6) formed between forks 46, 48, transverse sleeve 50 and transverse end plate 52, with forks 46, 48, due to their curved shape, extending on each side of tool arm 22. The only portion of thumb 40 which remains between tool arm 22 and the scooping side 26*a* of bucket 26, is the transverse end plate 52 and the end tips of forks 46, 48 which hold transverse end plate 52. In this position of thumb 40, thumb cylinder 42 extends through the transverse end plate notch 56. This opened limit position of thumb 40 is very advantageous in that thumb is not cumbersome, since it is stored out of the way of bucket 26, which can consequently be used independently of thumb 40. In this opened position of thumb 40, a significant portion of thumb 40 extends beyond the surface 22*a* of tool arm 22 which is in pivotal facing register with the scooping side 26*a* of pivotable bucket 26 (FIG. 4). Thus, bucket 26 may have a full range of pivotal displacement even though tool arm 22 is equipped with thumb 40, since the latter is positioned out of the way.

In its closed condition, thumb 40 can co-operate with bucket 26 to handle materials, for example a cylindrical container C as shown in FIG. 7. The thumb transverse endplate 52 can indeed abut against the outer free tip 60 of bucket 26, to form a hollow transverse opening between bucket 26 and the curved forks 46, 48. Due to this curved shape of forks 46, 48, objects or materials such as container C can be grasped in the hollow opening formed by forks 46, 48 and bucket 26, without being compressed. This is advantageous, since it prevents such materials from being damaged.

Thus, the U-shaped forks 46, 48 have a significant curve that allows them: (1) to be stored on each side of tool arm 22 in the inoperative condition of thumb 40, out of the way of the angular travel path of the bucket 26; and (2) to co-operate with bucket 26 in its operative closed position to grasp and handle materials while providing a hollow opening between the thumb forks 46, 48 and the bucket 26, so as to enable many articles being grasped and handled to project through and being this hollow opening without being compressed or damaged.

Figure 5:
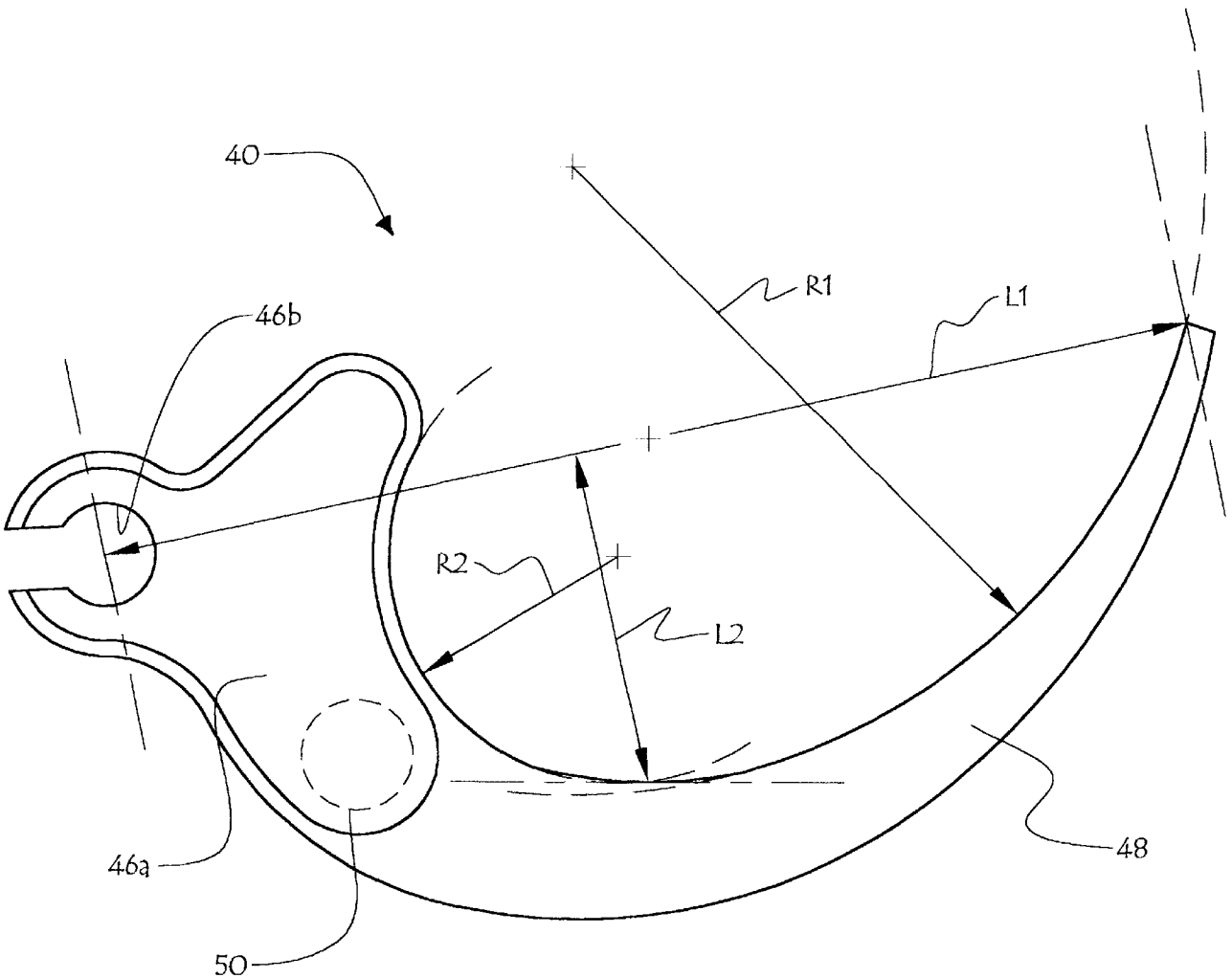
FIGS. 5 and 6 are respectively a side elevation and a rear elevation of the thumb of the invention, at an enlarged scale.
Figure 6:
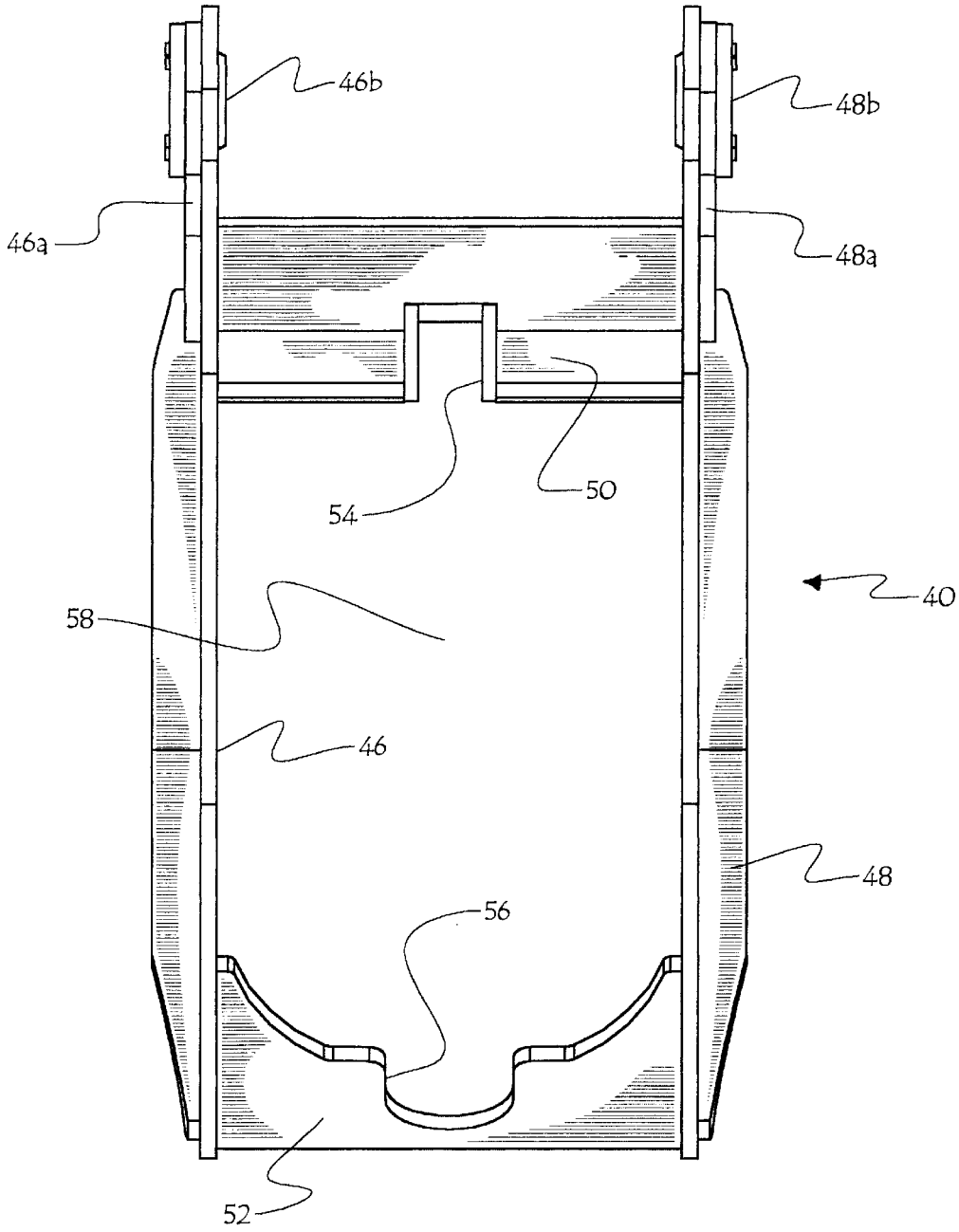

FIG. 5 shows that the thumb forks 46, 48 have significantly short radii of curvature. Typically, these radii of curvature will be shorter than that of bucket 26. It is understood that the size of thumb will vary according to the tool it is intended to be used with, but the following values, given by way of example, have been found to provide advantageous and unexpected results:

R1: 28 inches; R1 is the larger radius of curvature defining most of the forks' curvature at the free end thereof;

R2: 13 inches; R2 is the smaller radius of curvature defining the innermost portion of the forks;

L1: 60 inches; L1 is the spacing between the pivotal axis of thumb 40 and the outer free tip of forks 46, 48; and L2: 20 inches; L2 is the spacing between (a) a line linking the pivotal axis of thumb 40 and the outer free tips of forks 46, 48, and (b) the most distant portion of the inner surface of forks 46, 48 relative to this line and calculated at a right angle relative to this line.

Thus, it can be seen that the following approximated ratios are defined:

L1:L2=3:1

L1:R1=2:1

R1:R2=2:1

It is understood, however, that the above-mentioned dimensions and ratios may be modified without departing from the scope of the present invention.

It is understood that the bucket 26 could be replaced with any suitable hydraulically controlled scooping tool, such as a rake or the like.

Also, the shape of thumb 40 could be modified without departing from the scope of the present invention. For example, the transverse end plate 52 could be removed, although that would structurally weaken thumb 40 unless it was made from a very resistant material.

Furthermore, each hydraulic cylinder may be substituted by any suitable actuator.

Any further modification to the present invention, which does not deviate from the scope thereof, is considered to be included therein.

I claim:

1. A thumb to be mounted for relative movement on a hydraulic tool arm equipped with a pivotable scooping tool for selective co-operation between the scooping tool and said thumb, said thumb comprising a pair of generally parallel transversely spaced-apart arcuate U-shaped lateral forks, said forks having inner ends for operative coupling of said thumb to the tool arm for relative movement thereabout, and outer ends opposite said inner ends, said arcuate forks defining a significantly short radius of curvature about a common axis relative to the distance between said inner and outer ends, said thumb comprising an opening forming a tool arm channel extending between said forks inner and outer ends and located between said forks, said tool arm channel being completely devoid of any structural elements for allowing the tool arm to extend through said tool arm channel and be partly embedded in said tool arm opening in a stored position of said thumb.

2. A thumb as defined in claim 1, further comprising a transverse plate integrally linking said forks at said outer ends thereof and a coupling member integrally linking said inner ends of said forks, said transverse plate, said coupling member and said forks thereby forming a generally annular thumb main body around said tool arm opening.

3. A thumb as defined in claim 2, wherein said coupling member is a pivotal coupling member and defines a pivotal axis.

4. A thumb as defined in claim 3, wherein said forks define a concave inner surface and wherein a ratio L1:L2 approximately equal to 3:1 is defined on said thumb, where L1 is equal to the length between said pivotal axis and said forks outer ends, and where L2 is equal to the length between (a) a line drawn between said pivotal axis and said forks outer ends, and (b) the most distant point between said concave inner surface of said forks and said line, calculated at a right angle relative to said line.

5. A thumb as defined in claim 3, wherein said forks are defined along a major part of their length starting at said outer ends, by a single radius of curvature R1, and wherein a ratio L1:R1 approximately equal to 2:1 is defined on said thumb, where L1 is equal to the length between said pivotal axis and said forks outer ends.

6. A tool arm assembly comprising an elongated tool arm having an outer free end equipped with a scooping tool and a thumb, said thumb comprising a pair of generally parallel U-shaped spaced-apart lateral forks defining an opening therebetween devoid of any structural elements and forming a tool arm channel extending between said forks, said forks having inner ends, a pivot member pivotably attaching said forks inner ends to the tool arm outer free end for pivotal movement of said thumb about a pivotal axis, and outer ends opposite said inner ends, said forks being significantly curved about a common axis and defining a concave scooping side, said scooping tool selectively co-operating with said thumb and comprising an inner end pivotably attached to said pivot member for pivotal motion relative to said tool arm outer free end, an outer end opposite said inner end, and a scooping side in pivotal facing register with said thumb for grasping objects between said thumb and said scooping tool scooping side, said tool arm assembly further comprising a first power actuator operatively attached to said tool arm and to said thumb for selectively pivoting said thumb relative to said scooping tool and to said tool arm, said tool arm assembly further comprising a second power actuator operatively attached to said tool arm and to said scooping tool for selectively pivoting said scooping tool relative to said thumb and to said tool arm;

wherein said pivot member enables said thumb and said scooping tool to be independently pivotable relative to one another and to said tool arm about parallel axes, and wherein said thumb is pivotable between a first limit position in which said forks outer end engages said scooping tool scooping side and said scooping tool scooping side is in facing register with said forks scooping side, and a second limit position in which said thumb is pivoted away from said scooping tool scooping side and said tool arm is embedded in said opening between said thumb forks and extends within said tool arm channel, with a transverse hollow opening being defined between said forks and said scooping tool scooping side in said first limit position of said forks for transverse, uncompressed engagement of objects carried therein, and with a significant portion of said thumb extending beyond a surface of said tool arm that is in pivotal facing register with said scooping tool scooping side when said thumb is in said second limit position.

7. A tool arm as defined in claim 6, wherein said thumb and said scooping tool both pivot about said pivotal axis.

8. A tool arm as defined in claim 7, wherein said thumb comprises a transverse plate integrally linking said forks at said outer ends thereof, with said transverse plate being positioned, in all positions of said thumb, between said scooping tool scooping side and said surface of said tool arm that is in pivotal facing register with said scooping tool scooping side, said pivot member integrally linking said inner ends of said forks, said transverse plate, said pivot member and said forks thereby forming a generally annular thumb main body around said tool arm opening.

9. A tool arm as defined in claim 6, wherein said forks define a concave inner surface, and wherein a ratio L1:L2 approximately equal to 3:1 is defined on said thumb, where L1 is equal to the length between said pivotal axis and said forks outer ends, and where L2 is equal to the length between (a) a line drawn between said pivotal axis and said forks outer ends, and (b) the most distant point between said concave inner surface of said forks and said line, calculated at a right angle relative to said line.

10. A tool arm as defined in claim 6, wherein said forks are defined along a major part of their length starting at said outer ends, by a single radius of curvature R1, and wherein a ratio L1:R1 approximately equal to 2:1 is defined on said thumb, where L1 is equal to the length between said pivotal axis and said forks outer ends.

11. A vehicle comprising:

a frame movable over ground;

a boom pivotably attached to said frame;

an elongated tool arm having an inner end pivotally attached in said boom and an outer free end opposite said inner end and equipped with a scooping tool and a thumb, said thumb comprising a pair of generally parallel U-shaped spaced-apart lateral forks defining an opening therebetween devoid of any structural elements and forming a tool arm channel extending between said forks, said forks having an inner end pivotably attached to the tool arm outer free end and an outer end opposite said inner end, said forks being significantly curved about a common axis, said scooping tool selectively co-operating with said thumb and comprising an inner end pivotably attached to the tool arm outer free end, an outer end opposite said inner end, and a scooping side in pivotal facing register with said thumb for grasping objects between said thumb and said scooping tool scooping side;

a first actuator operatively attached to said tool arm and to said thumb for selectively pivoting said thumb relative to said scooping tool and to said tool arm;

a second actuator operatively attached to said tool arm and to said scooping tool for selectively pivoting said scooping tool relative to said thumb and to said tool arm;

a third actuator operatively attached to said boom and to said tool arm, for selectively pivoting said tool arm relative to said boom;

a fourth actuator operatively attached to said vehicle frame and to said boom, for selectively pivoting said boom relative to said vehicle;

wherein said thumb and said scooping tool are independently pivotable about parallel axes, and wherein said thumb is pivotable between a first limit position in which said forks outer end engages said scooping tool scooping side, and a second limit position in which said thumb is pivoted away from said scooping tool scooping side and said tool arm is embedded in said opening between said thumb forks and extends within said tool arm channel, with a transverse hollow opening being defined between said forks and said scooping tool scooping side in said first limit position of said forks for transverse, uncompressed engagement of objects carried therein, and with a significant portion of said thumb extending beyond a surface of said tool arm that is in pivotal facing register with said scooping tool scooping side when said thumb is in said second limit position.

12. A vehicle as defined in claim 11, wherein said scooping tool is a bucket.

13. A vehicle as defined in claim 12, wherein said scooping tool is a rake.

14. A vehicle as defined in claim 11, wherein said thumb comprises a transverse plate integrally linking said forks at said outer ends thereof, with said transverse plate being positioned, in all positions of said thumb, between said scooping tool scooping side and said surface of said tool arm that is in pivotal facing register with said scooping tool scooping side.

* * * * *